US008182364B2

(12) United States Patent
Cole et al.

(10) Patent No.: US 8,182,364 B2
(45) **Date of Patent: *May 22, 2012**

(54) GOLF CLUBS WITH CAVITIES, AND RELATED METHODS

(75) Inventors: Eric V. Cole, Phoenix, AZ (US); Randall B. Noble, Phoenix, AZ (US); Eric J. Morales, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/071,309

(22) Filed: Mar. 24, 2011

(65) Prior Publication Data

US 2011/0177878 A1 Jul. 21, 2011

Related U.S. Application Data

(63) Continuation of application No. 11/954,598, filed on Dec. 12, 2007, now Pat. No. 7,938,739.

(51) Int. Cl.
*A63B 53/04* (2006.01)
*A63B 53/06* (2006.01)

(52) U.S. Cl. ..... 473/335; 473/350

(58) Field of Classification Search ..... 473/324–350
See application file for complete search history.

(56) References Cited

U.S. PATENT DOCUMENTS

| | | | | |
|---|---|---|---|---|
| 645,942 | A | 3/1900 | Cran | |
| 1,453,503 | A | 5/1923 | Holmes | |
| 1,529,009 | A * | 3/1925 | Carpenter | 473/306 |
| 2,460,445 | A | 2/1949 | Bigler | |
| 2,998,254 | A | 8/1961 | Rains et al. | |
| 3,845,960 | A | 11/1974 | Thompson | |
| 3,961,796 | A | 6/1976 | Thompson | |
| 3,979,122 | A | 9/1976 | Belmont | |
| 4,008,896 | A | 2/1977 | Gordos | |
| 4,145,052 | A | 3/1979 | Janssen et al. | |
| 4,607,846 | A | 8/1986 | Perkins | |
| 4,962,932 | A | 10/1990 | Anderson | |
| 5,011,151 | A | 4/1991 | Antonious | |
| 5,013,041 | A | 5/1991 | Sun et al. | |
| 5,014,993 | A | 5/1991 | Antonious | |
| 5,489,097 | A | 2/1996 | Simmons | |
| 5,540,436 | A | 7/1996 | Boone | |
| 5,549,297 | A | 8/1996 | Mahaffey | |
| 5,586,947 | A | 12/1996 | Hutin | |
| 5,649,872 | A | 7/1997 | Antonious | |
| 5,688,189 | A | 11/1997 | Bland | |
| 5,800,282 | A | 9/1998 | Hutin et al. | |
| 6,080,069 | A | 6/2000 | Long | |
| 6,206,790 | B1 | 3/2001 | Kubica et al. | |
| 6,210,290 | B1 | 4/2001 | Erickson et al. | |
| 6,290,609 | B1 | 9/2001 | Takeda | |
| 6,309,311 | B1 | 10/2001 | Lu | |
| 6,379,263 | B2 | 4/2002 | Erickson et al. | |
| 6,431,995 | B1 | 8/2002 | Jackson | |
| 6,440,006 | B1 | 8/2002 | Johnson | |
| 6,450,897 | B2 | 9/2002 | Stites et al. | |
| 6,454,665 | B2 | 9/2002 | Antonious | |

(Continued)

FOREIGN PATENT DOCUMENTS

| | | | |
|---|---|---|---|
| JP | 08238343 | A | 9/1996 |

(Continued)

*Primary Examiner* — Alvin Hunter

(57) ABSTRACT

Embodiments of golf clubs with one or more cavities described herein.

Related examples and methods are also disclosed herein.

20 Claims, 6 Drawing Sheets

U.S. PATENT DOCUMENTS

| | | | | |
|---|---|---|---|---|
| 6,554,722 | B2 | 4/2003 | Erickson et al. | |
| 6,592,468 | B2 | 7/2003 | Vincent et al. | |
| 6,595,870 | B2 | 7/2003 | Stites et al. | |
| 6,616,547 | B2 | 9/2003 | Vincent et al. | |
| 6,835,144 | B2 | 12/2004 | Best | |
| 6,923,734 | B2 | 8/2005 | Meyer | |
| 6,942,580 | B2 | 9/2005 | Hou et al. | |
| 6,962,538 | B2 | 11/2005 | Roach et al. | |
| 7,207,900 | B2 | 4/2007 | Nicolette et al. | |
| 7,244,188 | B2 | 7/2007 | Best | |
| 7,303,486 | B2 | 12/2007 | Imamoto | |
| 7,351,161 | B2 | 4/2008 | Beach | |
| 7,351,164 | B2 | 4/2008 | Schweigert et al. | |
| 7,396,299 | B2 | 7/2008 | Nicolette et al. | |
| 7,507,167 | B2 | 3/2009 | Roach et al. | |
| 7,588,503 | B2 | 9/2009 | Roach et al. | |
| 7,938,739 | B2 * | 5/2011 | Cole et al. | 473/332 |
| 2002/0082113 | A1 | 6/2002 | Su | |
| 2005/0026716 | A1 | 2/2005 | Wahl et al. | |
| 2005/0239572 | A1 | 10/2005 | Roach et al. | |
| 2005/0266932 | A1 | 12/2005 | Roach et al. | |
| 2005/0277485 | A1 | 12/2005 | Hou et al. | |
| 2006/0100029 | A1 | 5/2006 | Lo | |
| 2006/0172822 | A1 | 8/2006 | Liang et al. | |

FOREIGN PATENT DOCUMENTS

| | | | |
|---|---|---|---|
| JP | 10192459 | A | 7/1998 |
| JP | 2001029517 | A | 2/2001 |
| JP | 2001037929 | A | 2/2001 |
| JP | 2002052101 | A | 2/2002 |
| JP | 2002065913 | A | 3/2002 |
| JP | 2003236025 | A | 8/2003 |
| JP | 2004159680 | A | 6/2004 |

* cited by examiner

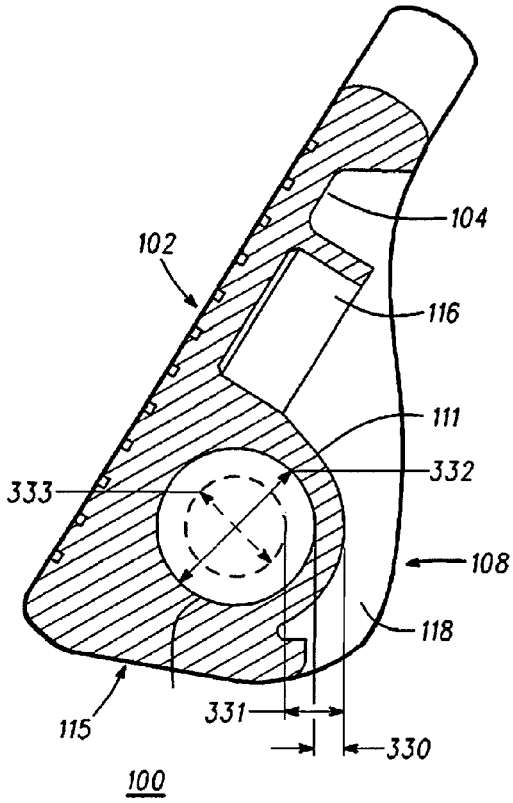
Fig. 3
Fig. 4
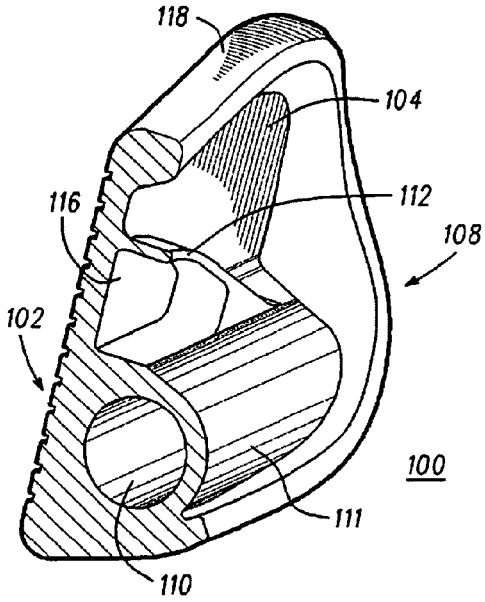
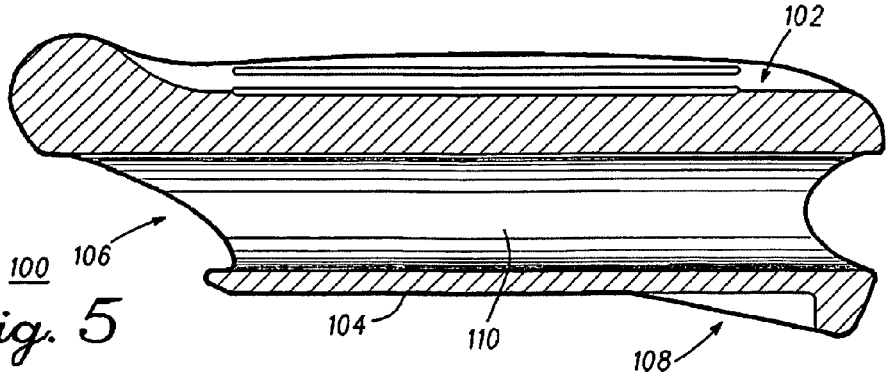
Fig. 5

800

900

GOLF CLUBS WITH CAVITIES, AND RELATED METHODS

CROSS-REFERENCE TO RELATED APPLICATIONS

This patent application is a continuation application claiming priority to U.S. patent application Ser. No. 11/954,598, filed on Dec. 12, 2007. The disclosure of the referenced application is incorporated herein by reference.

TECHNICAL FIELD

This disclosure relates generally to golf clubs and their methods of manufacture, and relates more particularly to a golf club having a cavity.

BACKGROUND

Golf club manufacturers have designed golf club heads to accommodate the preferences of an individual as well as the individual's ability. Some golf club manufacturers have also designed golf club heads to accommodate other events associated with golf play. For example, some individuals dislike feeling vibrations in the golf club after hitting a golf ball. Thus, some golf club heads may be designed to lessen the undesirable vibrations during play, while maintaining elements to assist the individual with his/her game.

BRIEF DESCRIPTION OF THE DRAWINGS

FIG. 3 depicts a cross-sectional view of the exemplary golf club head of FIG. 1, taken along a section line 3-3 in FIG. 1 and having an empty cavity;

FIG. 4 depicts a perspective view of a cross-section depicted in FIG. 3;

FIG. 5 depicts a second cross-sectional view of the exemplary golf club head of FIG. 1, taken along a section 5-5 in FIG. 1 and having an empty cavity;

Figure 1:
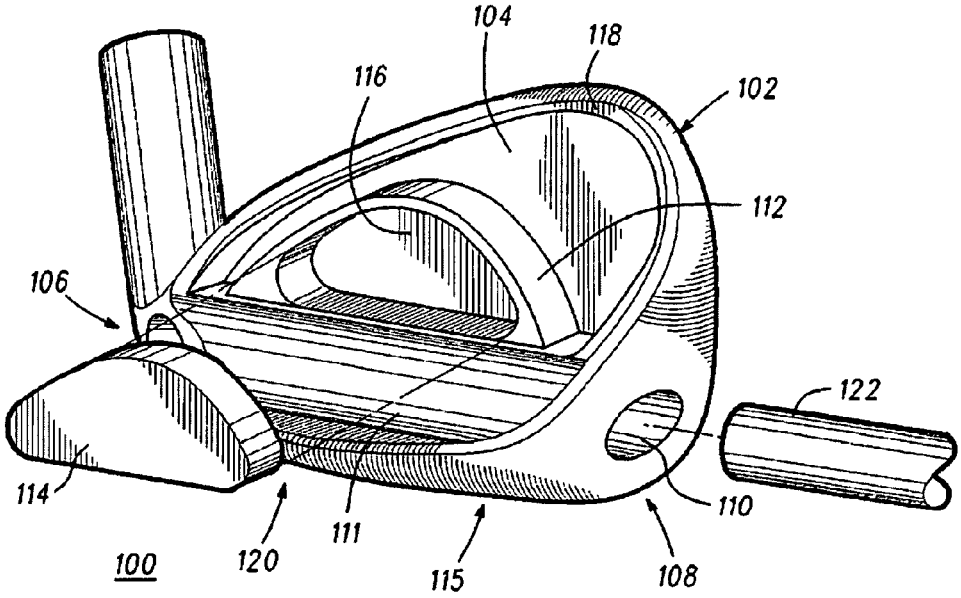
FIG. 1 depicts an exploded, perspective view of an exemplary golf club head with a cavity according to a first embodiment.

For simplicity and clarity of illustration, the drawing figures illustrate the general manner of construction, however, descriptions and details of well-known features and techniques can be omitted to avoid unnecessarily obscuring golf clubs with vibration dampeners and their methods of manufacture. Additionally, elements in the drawing figures are not necessarily drawn to scale. For example, the dimensions of some of the elements in the figures can be exaggerated relative to other elements to help improve understanding of embodiments of golf clubs with vibration dampeners and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs with vibration dampeners and their methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but can include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs with vibration dampeners and their methods of manufacture described herein are, for example, capable of operation in other orientations than those illustrated or otherwise described herein. The term "coupled," as used herein, is defined as directly or indirectly connected in a physical, mechanical, electrical, magnetic, or other manner.

DESCRIPTION

In an exemplary embodiment of a golf club with a cavity, an exemplary golf club head can comprise: a strike face; a back face opposite the strike face; a heel region; a toe region opposite the heel region; and a cavity integral with the golf club head. The cavity extends from the heel region to the toe region, extends along a lower portion of the back face of the golf club head, extends approximately parallel to the strike face, and is approximately symmetrical about a centerline that bisects the golf club head between the heel region and the toe region.

In another exemplary embodiment of a golf club with a cavity, an exemplary golf club can comprise: a golf club body; and a shaft coupled to the golf club body. The golf club body can comprise: a front face; a back face opposite the front face; a heel region; a toe region opposite the heel region; and a perimeter weight extending from the back face in a direction away from the front face and beyond the back face. A cavity extends from the heel region to the toe region, and extends along a lower portion of the back face of the golf club body at the back face, and is about parallel with the front face and the back face. A wall defining a portion of the cavity extends away from the back face in an arcuate fashion from the back face towards the sole.

In another exemplary embodiment, an exemplary method can comprise: providing a strike face; providing a back face opposite the strike face; providing a heel region; providing a toe region opposite the heel region; and providing a cavity integral with the golf club head. The cavity: extends from the heel region to the toe region; extends along a lower portion of the back face of the golf club head at the back face; extends approximately parallel to the strike face and the back face; and is approximately symmetrical about a centerline that bisects the golf club head between the heel region and the toe region.

In another exemplary embodiment, a golf club head can comprise a strike face, a back face opposite the strike face, a heel region, a toe region opposite the heel region, a cavity at the back face, and a filler material located in the cavity, the filler material comprising a density less than a density of the golf club head. The cavity can extend from the heel region to the toe region and can extend along a lower portion of the back face of the golf club head. The back face can comprise a back wall defining at least in part an interior of the cavity. The filler material can comprises at least one of: (a) a first filler density that decreases along the cavity from the heel region towards the toe region, or (b) a second filler density that decreases along the cavity from the toe region towards the heel region.

In another exemplary embodiment, a golf club can comprise a golf club body, and a vibration dampening material. The golf club body can comprise a front face, a back face opposite the front face, a heel region, a toe region opposite the heel region, a cavity extending from the heel region to the toe region, and a back wall coupled with the back face and defining a portion of the cavity. The cavity can comprise an interior, a cavity toe end towards the toe region, a cavity heel end towards the heel region. The back wall can extend from the back face and substantially isolate the interior of the cavity such that the cavity is accessible at one or both of the cavity toe end or the cavity heel end. The vibration dampening material can be located within the cavity and can comprises a first density and a second density. The first density can be at least one of (a) decreasingly dense along the cavity from the heel region towards the toe region, or (b) increasingly dense along the cavity from the heel region towards the toe region. The second density can be at least one of (a) decreasingly dense along the cavity from the toe region towards the heel region, or (b) increasingly dense along the cavity from the toe region towards the heel region.

In another exemplary embodiment, a method can comprise providing a back face of a golf club head, providing a strike face opposite the back face, providing a heel region, providing a toe region opposite the heel region, providing a first cavity at the back face, and providing a filler material in the first cavity, the filler material comprising a density less than a density of the golf club head. The first cavity can extend from the heel region to the toe region along a lower portion of the back face. The back face can comprise a back wall defining at least in part an interior of the first cavity. The filler material can comprise a first density and a second density. The first density can be at least one of (a) decreasingly dense along the first cavity from the heel region towards the toe region, or (b) increasingly dense along the first cavity from the heel region towards the toe region. The second density can be at least one of (a) decreasingly dense along the first cavity from the toe region towards the heel region, or (b) increasingly dense along the first cavity from the toe region towards the heel region.

Other examples and embodiments are further disclosed herein. Such examples and embodiments may be found in the figures, in the claims, and/or in the description of the present application.

Turning now to the figures, FIGS. 1-6 depict a golf club head 100 comprising: a strike face 102; a back face 104 opposite strike face 102; a heel region 106; a toe region 108 opposite heel region 106; and a cavity 110 integral with golf club head 100. Cavity 110 extends from heel region 106 to toe region 108; extends along a lower portion 120 of back face 104 of golf club head 100; extends approximately parallel to strike face 102 and back face 104; and is approximately symmetrical about a centerline 224 (FIG. 2) that bisects golf club head 100 between heel region 106 and toe region 108. Cavity 110 can further comprise a filler material 122 to dampen vibrational energy experienced by golf club head 100 when golf club head 100 strikes an object, such as, a golf ball.

Figure 2:
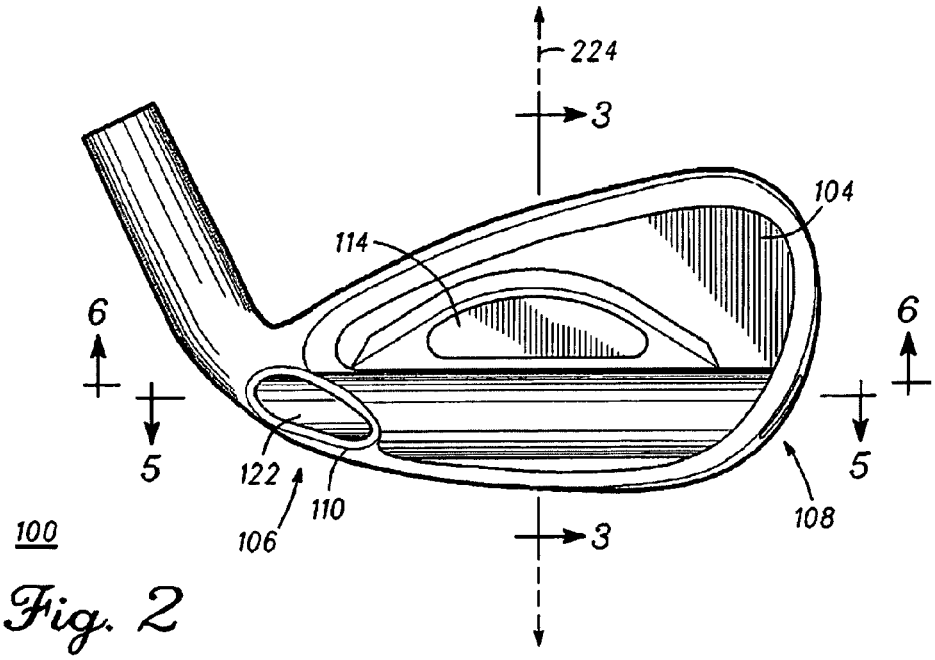
FIG. 2 depicts a back view of the exemplary golf club head of FIG. 1.
Figure 6:
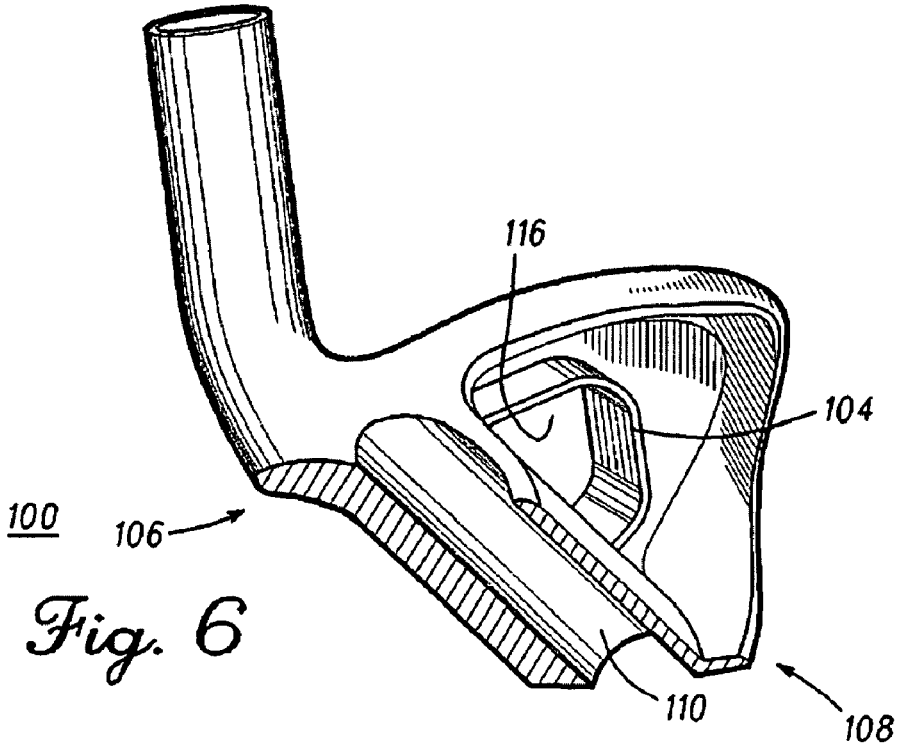
FIG. 6 depicts a perspective view of the cross-section depicted in FIG. 5 according to the exemplary golf club head of FIG. 1, taken along a section line 6-6 in FIG. 1.

In other embodiments, cavity 110 is not parallel to strike face 102 and/or back face 104. In the same or a different embodiment, cavity 110 is not symmetrical about centerline 224 (FIG. 2). Additionally, cavity 110 can remain empty (e.g., without a back weight).

Golf club head 100 further comprises at back face 104, an arcuate rib 112 that extends from heel region 106 to toe region 108, extends away from back face 104, and defines a portion of a secondary cavity 116 to receive a back weight 114. Golf club head 100 can further comprise a perimeter weight 118 that extends away from back face 104. With momentary reference to FIG. 2, FIG. 2 depicts filler material 122 within cavity 110, and back weight 114 affixed within secondary cavity 116 (FIG. 1). FIG. 2 further depicts centerline 224 that bisects golf club head 100 and illustrates how: cavity 110; filler material within cavity 110; secondary cavity 116; and back weight 114 are generally symmetric about centerline 224. It should be noted that the term symmetric is used throughout this detailed description in the broadest sense and is not intended to be strictly interpreted, as the various elements are described, as being exact mirror images of each other about a reference point, line, or plane to the other. Instead, the term symmetric should be interpreted to generally indicate that the various elements described, while they may be exact mirror images of each other about a reference point, line, or plane, symmetric can also mean approximately similar, or having a majority of the physical characteristics to be similar about a reference point, line, or plane.

Among the various embodiments described herein, and as briefly described above, cavity 110 extends from heel region 106 to toe region 108. As can be seen among FIGS. 1 and 2, cavity 110 comprises an opening at toe region 108 and an opening at heel region 106. In a different embodiment, cavity 110 can comprise an opening at only one end, for example, merely a single opening at toe region 108 or a single opening at heel region 106. Furthermore, as best seen in FIG. 1, cavity 110 comprises an opening size commensurate with or slightly smaller than the size of filler material 122 that inserts into cavity 110. In some embodiments, however, cavity 110 opening can comprise a small opening or access point into cavity 110 to accommodate an injection device that can inject, for example, an expandable type of filler material 122. In such an embodiment, cavity 110 can be essentially closed at both ends except for the small opening or access point into cavity 110. Moreover, such an opening or access point into cavity 110 can be located at both or either toe region 108 end and heel region 106 end.

Continuing with cavity 110, and among the various embodiments described herein, cavity 110 can comprise a number of configurations depending on the needs of the user or golfer. In general, cavity 110 can extend along a lower portion 120 of back face 104 of golf club head 100, and cavity 110 can provide bottom or sole weighting of golf club head 100. The housing to accommodate the dampening vibrational material can also provide bottom or sole weighting of golf club head 100. As can be seen from FIGS. 1 and 2, cavity 110 comprises an elongated, consistent "tubular" shape extending from heel region 106 to toe region 108. Moreover, cavity 110 comprises a wall 111 that defines a portion of cavity 110, as well as secondary cavity 116, and wall 111 extends away from back face 104 in an arcuate fashion from back face 104 towards a sole 115 of golf club head 100.

Among the various embodiments described herein, and as can be further seen from FIGS. 1 and 2, cavity 110 generally comprises a round opening to accommodate the insertion of filler material 122. In one embodiment, the opening can be circular. The diameter of the cavity is generally consistent along the length of the cavity, but, in other embodiments, the size of the cavity and the corresponding opening can vary depending on the specifics of golf club head 100. For example, the cavity diameter and the opening diameter in one embodiment each comprises an opening of 0.50 inches, but the cavity diameter and/or opening diameter can be larger or smaller. Moreover, in some embodiments, while the diameter of the cavity and the diameter of the opening can vary, the wall thickness of the cavity can likewise vary. With reference to FIG. 3, which depicts a cross-section of golf club head 100 taken along a section line 3-3 in FIG. 1, a wall thickness 330 and a corresponding cavity diameter 332 are shown. Also wall thickness and cavity diameter of the golf club head 100 can vary (e.g., a wall thickness 331 and a corresponding cavity diameter 333). Among various embodiments, these dimensions can be consistent from one golf club head to another in a given golf club set, or the dimensions can vary depending on the type of golf club, for example, the dimensions can vary between a 3 iron, 4 iron, 5 iron, etc.

Although the above figures may depict particular examples of cavities, the apparatus, methods, and/or articles of manufacture described herein may include a cavity with one or more threads, ridges, etc. to engage with filler material 122. For example, FIG. 5 may depict cavity 110 with a relatively uniform surface so that filler material 122 may be inserted into cavity 110 via a press or push motion. In contrast, each of cavity 110 and filler material 122 may include one or more threads, ridges, etc. so that cavity 110 and filler material 122 may engage with each other via a rotational or twisting motion. The apparatus, methods, and articles of manufacture described herein are not limited in this regard.

Figure 7:
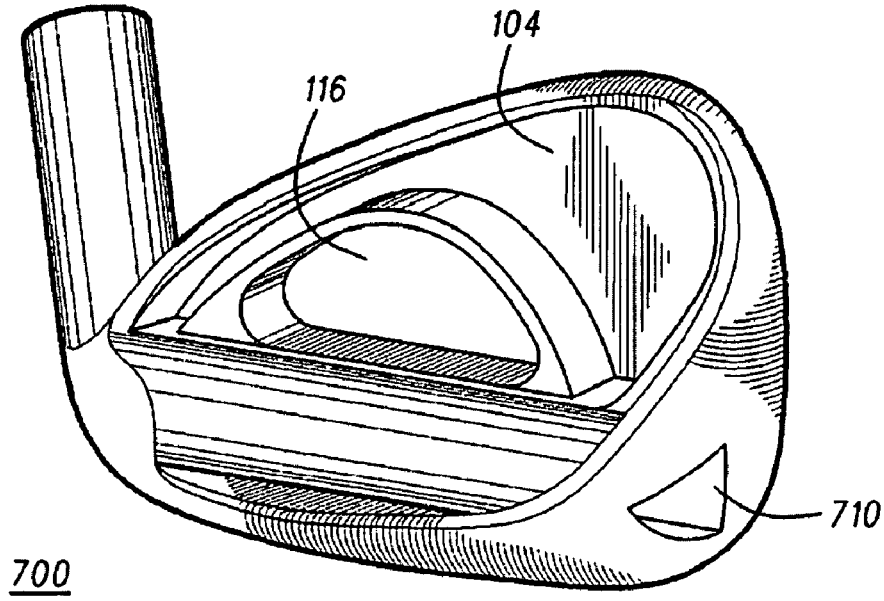
FIG. 7 depicts a perspective view of an exemplary golf club head with a cavity according to a second embodiment.
Figure 8:
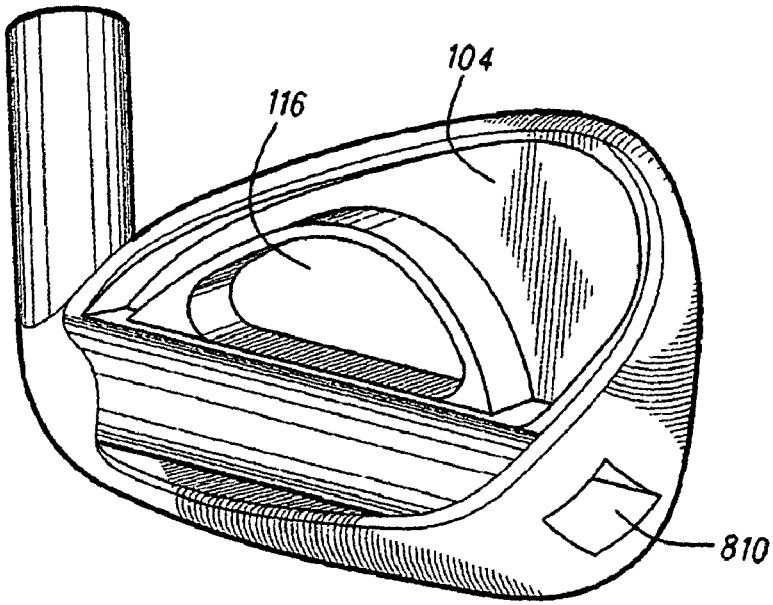
FIG. 8 depicts a perspective view of an exemplary golf club head with a cavity according to a third embodiment.
Figure 9:
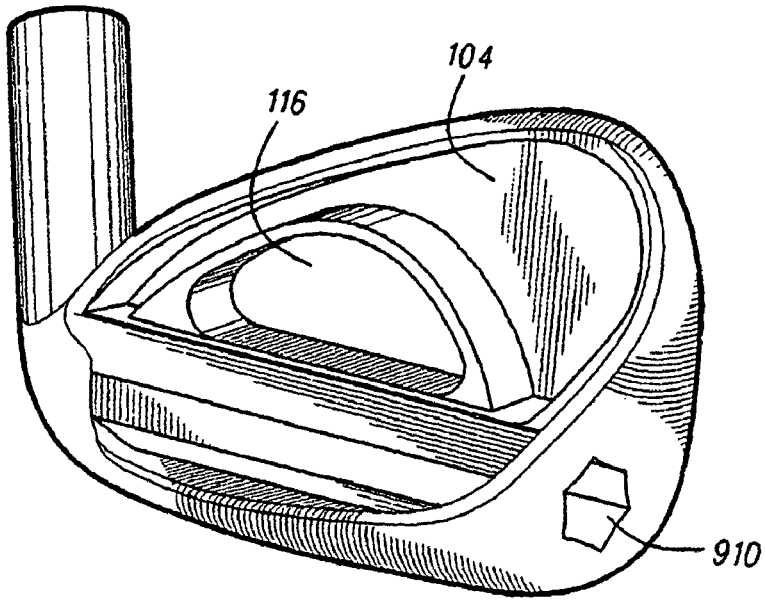
FIG. 9 depicts a perspective view of an exemplary golf club head with a cavity according to a fourth embodiment.

Among the various embodiments described herein, and continuing with cavity 110, some embodiments can comprise cavity shapes other than the elongated "tubular" embodiment described above. For example, with reference to FIGS. 7-9, other embodiments of cavity shapes are depicted. FIG. 7 depicts a golf club head 700 having a cavity 710 comprising a triangular shape; FIG. 8 depicts a golf club head 800 having a cavity 810 comprising a square or rectangular shape; and FIG. 9 depicts a golf club head 900 having a cavity 910 comprising a hexagonal shape. The cavity shapes depicted among the various FIGS. are not limiting, and cavities 110 (FIG. 1), 710 (FIG. 7), 810 (FIG. 8), and 910 (FIG. 9) can comprise any other shape configuration, regular or irregular, and/or orientation. Moreover, while cavities 110 (FIG. 1), 710 (FIG. 7), 810 (FIG. 8), and 910 (FIG. 9) can comprise other shape configurations, the exterior wall of the cavity can similarly comprise various regular or irregular shape configurations. For example, FIG. 9 depicts the exterior wall of cavity 910 comprising a portion of a hexagonal configuration.

Figure 10:
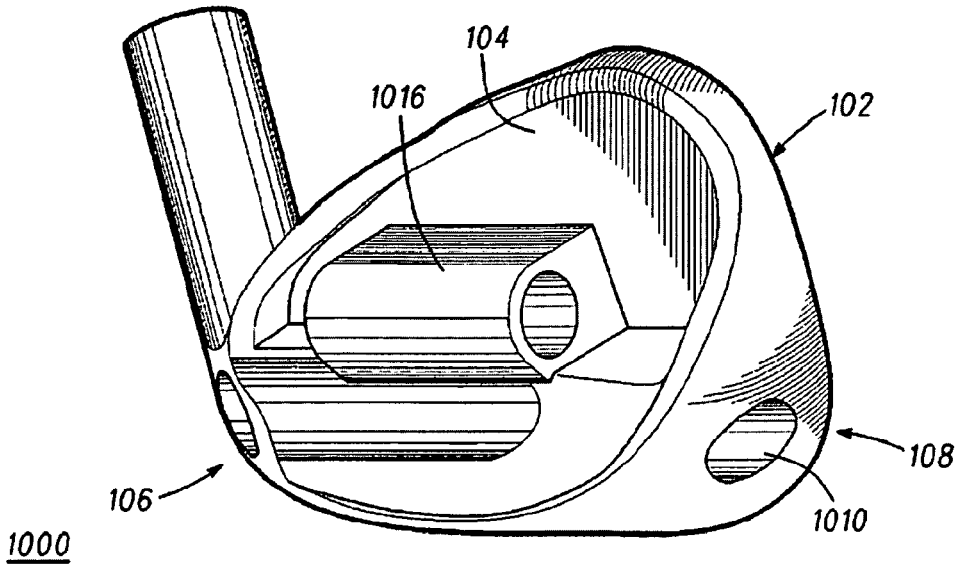
FIG. 10 depicts a perspective view of an exemplary golf club head with a cavity according to a fifth embodiment.
Figure 11:
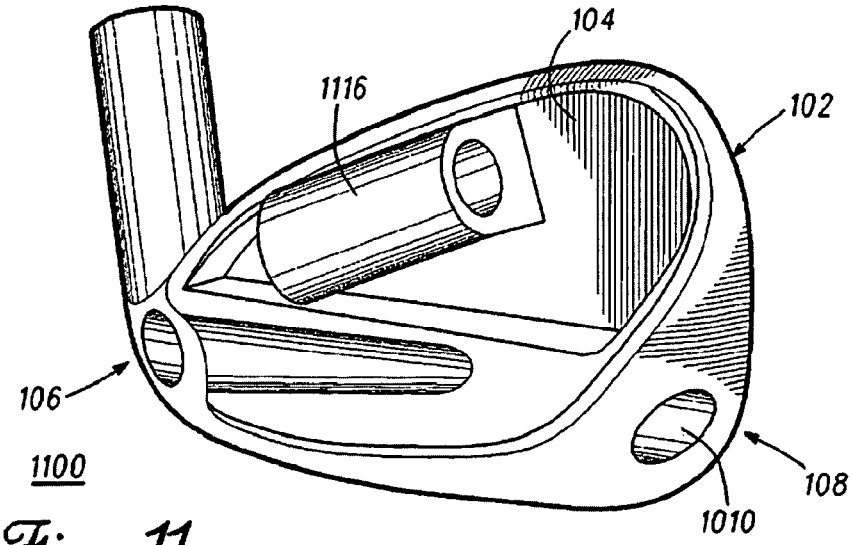
FIG. 11 depicts a perspective view of an exemplary golf club head with a cavity according to a sixth embodiment.

Among some embodiments, cavity 110 can further comprise a configuration that is irregularly shaped along back face 104. With reference to FIGS. 10 and 11, a golf club head 1000 (FIG. 10) and a golf club head 1100 (FIG. 11) includes a cavity 1010 comprising a maximum diameter at each end of the golf club head 1000 (i.e., heel region 106 and toe region 108), and, in one exemplary embodiment as depicted in FIG. 11, a minimum diameter between such ends. In particular, cavity 1010 (FIG. 11) may taper between heel region 106 and toe region 108. In one example, a first conical filler material may enclose cavity 1010 from heel region 106 and a second conical filler material may enclose cavity 1010 from toe region 108. Among some embodiments, as depicted in FIGS. 10 and 11, cavity 1010 can be angled inward or outward towards back face 104 from either or both heel region 106 and/or toe region 108.

Several exemplary embodiments have been described so far that depict various configurations of cavities. It should be noted that none of these embodiments are limiting and that golf club heads 100 (FIG. 1), 700 (FIG. 7), 800 (FIG. 8), 900 (FIG. 9), 1000 (FIG. 10), and/or 1100 (FIG. 11) can comprise other cavities.

Continuing with the detailed description, filler material 122 can comprise different embodiments to provide a vibration dampening function. Filler material 122 comprises any material that can dampen vibrations encountered by golf club head 100 during use, and generally has a density that is less than the density of the main body of golf club head 100, although filler material 122 density can be greater in some embodiments. These materials can be natural or synthetic, or a combination of both. The materials can comprise polymers, rubbers, foams, gels, composites of each, or composites of each other. The materials may be solid and inserted into cavity 110, or they can be injected materials, for example, expandable foams. The materials can also be poured, sprayed, molded, or any other type of material or operation that ultimately results in filler material 122 occupying cavity 110. In one exemplary embodiment, filler material 122 comprises a composite of an elastomer or rubber type material having numerous metal ball bearings embedded throughout to create a composite rubber-metal matrix, and in another embodiment, a polymer may be used in place of the rubber to create a polymer-metal material. Among such embodiments, the rubber or polymer can completely encompass the metal material or bearings, such that the metal material or bearings do not intersect the surface of the insert, i.e., the metal material or bearings reside within the internal volume of the insert. In this manner, there is no metal to metal contact between the metal material or bearings and the internal cavity wall when the insert is positioned in the cavity; only the polymer or rubber/elastomer surface contacts the internal cavity wall.

Some embodiments comprise filler material 122 occupying the entirety of cavity 110, but other exemplary embodiments comprise filler material 122 occupying only a portion of cavity 110, for example a coating of the interior walls of cavity 110. Additionally, a honeycomb-type material can be placed in cavity 110 that does not completely fill cavity 110 due to the air pockets within the honeycomb structure. It should be further noted that filler material 122 may be interchangeable with another type of filler material as the needs and/or preferences of an individual change.

In yet another exemplary embodiment of golf club head 100, filler material 122 comprises a first filler density and a second filler density, wherein the first filler density decreases from heel region 106 to centerline 224 (FIG. 2), the second filler density decreases from toe region 108 to centerline 224 (FIG. 2), and the second filler density comprises a similar density gradient as the first filler density. In still yet another exemplary embodiment, instead of the density gradient decreasing from either end towards centerline 224 (FIG. 2), the density gradient can increase from either end towards centerline 224 (FIG. 2).

Several exemplary embodiments have been described so far that depict various configurations of filler material 122. It should be noted that none of these embodiments are limiting and that any other permutations that permit golf club head 100 (FIG. 1), 700 (FIG. 7), 800 (FIG. 8), 900 (FIG. 9), 1000 (FIG. 10), and/or 1100 (FIG. 11) to comprise filler material 122, is contemplated by this disclosure.

Continuing with the detailed description and with continued reference to FIG. 1, golf club head 100 comprises arcuate rib 112. Arcuate rib 112 extends from heel region 106 to toe region 108, and extends away from back face 104. Arcuate rib 112 is similarly symmetric about centerline 224 (FIG. 2). Arcuate rib 112 can function to provide reinforcing support to back face 104, and further partially define secondary cavity 116. Arcuate rib 112 extends away from back face 104 in a generally perpendicular manner, however other angles from which arcuate rib 112 can extend away from back face 104 are contemplated by this disclosure. While arcuate rib 112 comprises the shape depicted among the various figures, some other embodiments may comprise arcuate rib 112 in a greater arcuate fashion or lesser arcuate fashion, i.e. having a greater or lesser radius of curvature. Moreover, while referred to as an arcuate rib in this detailed description, arcuate rib 112 can comprise portions of other shapes, such as an oval, triangle, square, and the like that can serve to partially define secondary cavity 116, and also provide support to back face 104 and/or front face 102.

In still yet other exemplary embodiments, and with reference to FIGS. 10 and 11, arcuate rib 112 can be replaced with a first embodiment of a secondary cavity 1016 (FIG. 10), or arcuate rib 112 can be replaced with a second embodiment of a secondary cavity 1116 (FIG. 11). These embodiments can likewise provide support to back face 104 and/or front face 102, but instead of providing a space to insert a back weight, cavities 1016 (FIG. 10) and 1116 (FIG. 11) provide a cavity similar to cavity 110 (FIG. 1) in that it allows further vibration dampening material to be added. In a different embodiment, a weight can be inserted into cavities 1016 (FIG. 10) and/or 1116 (FIG. 11).

Among various exemplary embodiments, returning to FIG. 1, golf club head 100 further comprises secondary cavity 116. Secondary cavity 116 provides a space to insert back weight 114. As mentioned above in this detailed description, secondary cavity 116 is partially defined by arcuate rib 112 and partially defined by wall 111. Moreover, and as described above, the secondary cavity may comprise cavities 1016 (FIG. 10) or 1116 (FIG. 11) and provide a cavity similar to cavity 110.

Several exemplary embodiments have been described so far that depict various configurations of secondary cavity 116 (FIGS. 1-4 and 6-9), 1016 (FIG. 10), and 1116 (FIG. 11), but it should be noted that none of these embodiments are limiting and that any other permutations that permit golf club head 100 to comprise a secondary cavity is contemplated by this disclosure.

Among various exemplary embodiments, continuing with FIG. 1, golf club head 100 comprises back weight 114. Back weight 114 is affixed in secondary cavity 116, and the back weight comprises a density greater than a density of golf club head 100. Back weight 114 is generally determined based upon the custom needs of an individual. Based on certain criteria, an appropriate back weight for the individual is selected for placement within secondary cavity 116. Back weight 114 can be affixed within secondary cavity 116 using any means commensurate for securing, for example, glues, epoxies, welds, snaps, clips, magnets, Velcro® material, and the like. Moreover, back weight 114 can be permanently affixed within secondary cavity 116, or back weight 114 can be removable so as to allow back weight 114 to be interchanged and/or adjusted as the needs of the individual change.

Among various exemplary embodiments, golf club head 100 comprises perimeter weighting 118. Perimeter weighting 118 generally extends from front face 102 towards and beyond back face 104, or perimeter weighting 118 can generally extend from back face 104 away from front face 102. In some exemplary embodiments, perimeter weight 118 extends beyond cavity 110 and wall 111 at sole 115 (FIG. 3). While several embodiments of golf club head 100 comprise perimeter weighting 118, the disclosure also contemplates golf club head 100 not comprising perimeter weighting, thus, resulting in a "blade" type golf club head.

Figure 12:
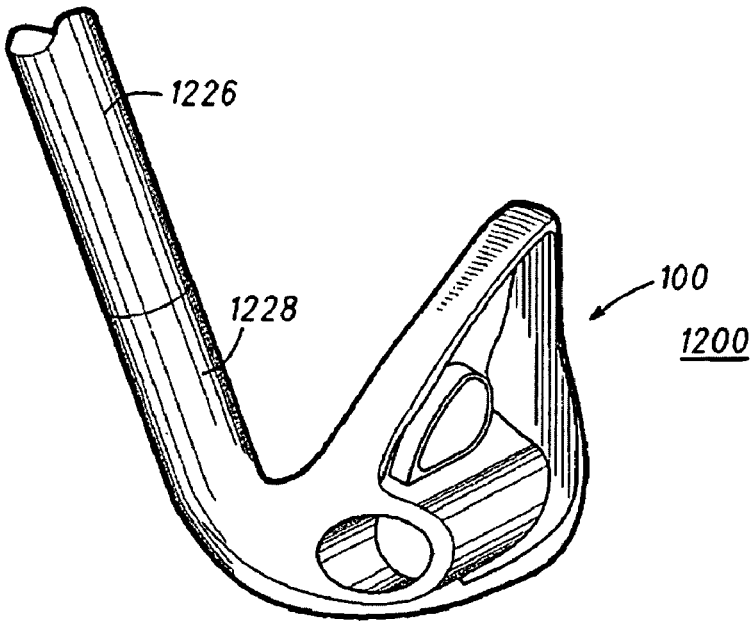
FIG. 12 depicts a perspective view of the exemplary golf club head of FIG. 1 shown coupled to a golf club shaft according to another embodiment.

Among the various embodiments described herein, and with reference to FIG. 12, golf club head 100 can further couple to a golf club shaft 1226 to form a golf club 1200. Some embodiments of golf club head 100 can comprise a hosel, such as a hosel 1228, which facilitates coupling golf club shaft 1226 to golf club head 100, or golf club head 100 can comprise merely a connection point or a hole to allow golf club shaft 1226 to couple to golf club head 100. Golf club shaft 1226 can comprise any type of golf club shaft and generally comprises a steel or graphite material, although any type of golf club shaft is contemplated by this disclosure.

Figure 13:
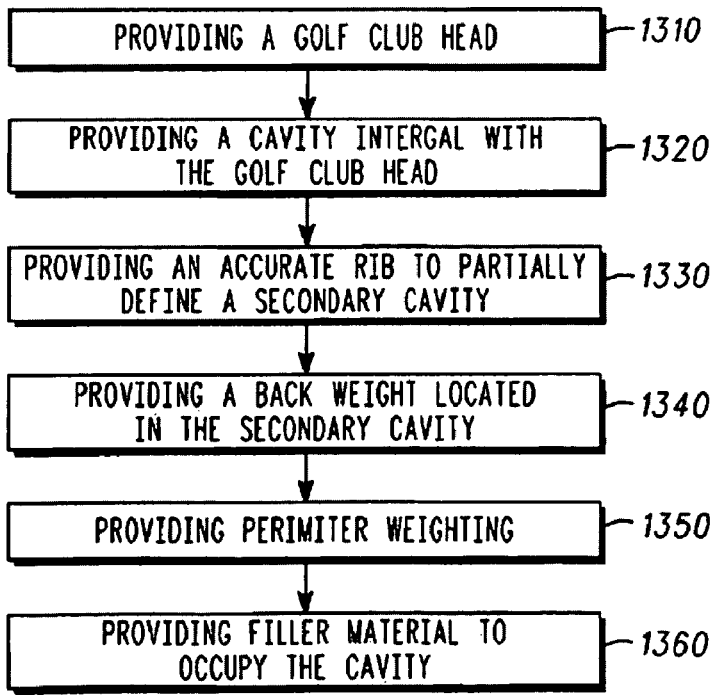
FIG. 13 depicts a flow diagram representation of a manner in which a golf club head with a vibration dampener can be manufactured, according to an additional embodiment.

In accordance with an exemplary embodiment of golf clubs with a vibration dampener and their method of manufacture, and with reference to FIG. 13, an exemplary method 1300 for manufacturing comprises: providing a golf club head (a block 1310); providing a cavity integral with the golf club head (a block 1320); providing an arcuate rib to partially define a secondary cavity (a block 1330); providing a back weight located in the secondary cavity (a block 1340); providing perimeter weighting (a block 1350); and providing a filler material to occupy the cavity (a block 1360).

Among various exemplary embodiments, providing the golf club head (the block 1310) comprises providing the golf club head to comprise: a strike face; a back face opposite the strike face; a heel region; and a toe region opposite the heel region, similar to golf club head 100 (FIG. 1). Providing the cavity integral with the golf club head (the block 1320) can comprise providing the cavity to: extend from the heel region to the toe region; extend along a lower portion of the back face of the golf club head at the back face; extend approximately parallel to the strike face and the back face; and be approximately symmetrical about a centerline that bisects the golf club head between the heel region and the toe region, similar to cavities 110 (FIGS. 1-4 and 6-9), and/or cavities 1010 (FIGS. 10 and 11). Providing an arcuate rib to partially define a secondary cavity (the block 1330) can comprise providing the arcuate rib to extend from the heel region to the toe region, extend away from the back face, and, as mentioned, define a portion of a secondary cavity, wherein the secondary cavity can receive a back weight. The arcuate rib can be similar to arcuate rib 112 (FIG. 1). Providing a back weight located in a secondary cavity (the block 1340) can comprise providing the back weight to be similar to back weight 114 (FIG. 1), and to comprise a density greater than a density of the golf club head. Providing a perimeter weight (the block 1350) can comprise providing the perimeter weight to be similar to perimeter weight 118 (FIG. 1) and can extend from the strike face in a direction towards the front face and beyond the back face, and the perimeter weight can extend beyond the cavity at a sole of the golf club head. Providing a filler material in the cavity (the block 1360) can comprise providing the filler material to comprise a density less than a density of the golf club head, and the filler material can comprise a polymer-metal matrix. The filler material can be similar to filler material 122 (FIG. 1).

Among the exemplary methods described herein, and although a particular order of actions is illustrated in FIG. 1300, these actions can be performed in other temporal sequences. For example, the actions depicted in FIG. 1300 can be performed sequentially, concurrently, or simultaneously. Additionally, block 1330 can be performed before or after blocks 1350, and/or 1360 (FIG. 13). Block 1350 can be performed before or after blocks 1330, and/or 1360 (FIG. 13). Moreover, as an additional example, block 1360 can be performed before or after blocks 1330, and/or 1350 (FIG. 13). Other variations of exemplary methods are also contemplated by this disclosure.

Additional examples of such changes have been given in the foregoing description. Accordingly, the disclosure of embodiments of golf clubs with one or more cavities and their methods of manufacture is intended to be illustrative of the scope of golf clubs and their methods of manufacture and is not intended to be limiting. For example, in one embodiment, a golf club with a cavity can have one or more features of FIG. 1, with or without the secondary cavity 116, filler material 122, and/or back weight 114. Other permutations of the different embodiments having one or more of the features of the various figures are likewise contemplated. It is intended that the scope of golf clubs with one or more cavities and their methods of manufacture shall be defined by the appended claims.

The golf clubs with one or more cavities and their methods of manufacture discussed herein can be implemented in a variety of embodiments, and the foregoing discussion of these embodiments does not necessarily represent a complete description of all possible embodiments. The detailed description of the drawings, and the drawings themselves, disclose at least one preferred embodiment of the golf clubs and their methods of manufacture, and can disclose alternative embodiments of such golf clubs and their methods of manufacture.

All elements claimed in any particular claim are essential to the golf clubs with one or more cavities and their methods of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that can cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a strike face;
a back face opposite the strike face;
a heel region;
a toe region opposite the heel region;
a cavity at the back face; and
a filler material located in the cavity, the filler material comprising a density less than a density of the golf club head;
wherein:
the cavity extends from the heel region to the toe region and extends along a lower portion of the back face of the golf club head;
the back face comprises a back wall defining at least in part an interior of the cavity; and
the filler material comprises at least one of:
a first filler density that decreases along the cavity from the heel region towards the toe region; or
a second filler density that decreases along the cavity from the toe region towards the heel region.

2. The golf club head of claim 1, wherein:
the interior of the cavity is substantially isolated by the back wall from a rear exterior of the golf club head when viewed from a rear of the golf club head.

3. The golf club head of claim 1, wherein:
the cavity is substantially symmetrical about a centerline of the golf club head.

4. The golf club head of claim 1, further comprising:
an arcuate rib at the back face, extending from the heel region to the toe region, extending away from the back face, and defining a portion of a secondary cavity;
wherein a volume of the cavity is separated by the back wall from a volume of the secondary cavity.

5. The golf club head of claim 1, further comprising:
an arcuate rib at the back face, extending from the heel region to the toe region, and extending away from the back face; and
a back weight located in a secondary cavity defined at least in part by the arcuate rib;
wherein:
the back weight comprises a density greater than a density of the golf club head.

6. The golf club head of claim 1, further comprising
a perimeter weight extending away from the back face.

7. The golf club head of claim 1, wherein
a cross-sectional area of the interior of the cavity is substantially constant along a full length of the cavity.

8. The golf club head of claim 1, wherein
the filler material comprises:
a first material comprising at least one of:
a polymer material, a rubber material, a foam material, or a gel material; and
a metallic material embedded within the first material.

9. The golf club head of claim 1, wherein:
the filler material comprises the first filler density and the second filler density.

10. The golf club head of claim 1, wherein:
the first and second filler densities comprise similar density gradients.

11. The golf club head of claim 1, further comprising:
a second cavity at the back face;
wherein a volume of the cavity is separated by the back wall from a volume of the second cavity.

12. The golf club head of claim 1, wherein:
the interior of the cavity is substantially tubular.

13. The golf club head of claim 1, wherein:
the filler material is insertable into the interior of the cavity via only at least one of:
an outer end of the toe region; or
an outer end of the heel region;
and
the interior of the cavity is substantially smooth.

14. The golf club head of claim 1, wherein
the filler material comprises a vibration dampening material; and the vibration dampening material substantially fills the interior of the cavity.

15. A golf club comprising:

a golf club body; and a vibration dampening material;

wherein:

the golf club body comprises:

a front face;

a back face opposite the front face;

a heel region;

a toe region opposite the heel region;

a cavity extending from the heel region to the toe region, the cavity comprising:

an interior;

a cavity toe end towards the toe region; and a cavity heel end towards the heel region;

and a back wall coupled with the back face and defining a portion of the cavity, the back wall extending from the back face and substantially isolating the interior of the cavity such that the cavity is accessible at one or both of the cavity toe end or the cavity heel end;

and the vibration dampening material is located within the cavity and comprises:

a first density being at least one of:

decreasingly dense along the cavity from the heel region towards the toe region; or increasingly dense along the cavity from the heel region towards the toe region;

and a second density being at least one of:

decreasingly dense along the cavity from the toe region towards the heel region; or increasingly dense along the cavity from the toe region towards the heel region.

16. The golf club of claim 15, wherein:

the cavity extends substantially symmetrically along a lower portion of the back face of the golf club body;

the first density of the vibration dampening material extends along the heel region to a centerline defining a junction between the heel region and the toe region of the golf club body; and the second density of the vibration dampening material extends along the toe region to the centerline.

17. The golf club of claim 15, wherein:

the vibration dampening material comprises:

a first material comprising at least one of a polymer material, a rubber material, a foam material, or a gel material; and a second material embedded within the first material and comprising a plurality of metal bearings.

18. The golf club of claim 15, further comprising:

a perimeter weight extending from the back face in a direction away from the front face;

wherein:

the cavity toe end is at an end of the toe region of the golf club body, and the cavity heel end is at an end of the heel region of the golf club body.

19. The golf club of claim 15, wherein:

the vibration dampening material comprises an overall density less than a density of the golf club body and substantially fills the interior of the cavity.

20. The golf club of claim 15, wherein the vibration dampening material comprises a polymer-metal matrix.

* * * * *